United States Patent [19]

Koehler

[11] 4,246,829

[45] Jan. 27, 1981

[54] REPEATING FIRING SYSTEM FOR GUNS

[75] Inventor: Erich Koehler, Hodenhagen, Fed. Rep. of Germany

[73] Assignee: Rheinmetall GmbH, Duesseldorf, Fed. Rep. of Germany

[21] Appl. No.: 960,780

[22] Filed: Nov. 15, 1978

[30] Foreign Application Priority Data

Nov. 15, 1977 [DE] Fed. Rep. of Germany ..... 2750957

[51] Int. Cl.[3] ..... F41F 13/04

[52] U.S. Cl. ..... 89/27 F

[58] Field of Search ..... 89/27 R, 27 F, 41 R, 89/136

[56] References Cited

U.S. PATENT DOCUMENTS 1,156,541 10/1915 Meigs et al. ..... 89/41 R 3,306,166 2/1967 Ramseyer ..... 89/136

FOREIGN PATENT DOCUMENTS 685430 7/1930 France ..... 89/27 F

*Primary Examiner*—Stephen C. Bentley

[57] ABSTRACT

There is disclosed a repeating firing system for a weapon with a barrel mounted on a lower gun carriage which is horizontally traversed by the gunner, the barrel being capable of being elevated through a substantial angular range. The system includes a firing device capable of repeated operation which serves to actuate a striker pin device disposed on the barrel of the weapon and serving to initiate the firing of the weapon. The firing system has a firing lever operable by the gunner from his weapon sighting and firing position, the firing lever serving to displace a release element, in opposition to the restoring force of a spring, from a position of rest to a firing position, from which, after the firing lever has been turned to effect the firing operation, it is returned by the restoring force of the spring to the position of rest in order to be ready to repeat the firing operation. The system includes means connecting the firing lever with a manual firing lever mounted on the lower gun carriage at the gunner's position in a fixed position relative to the directional and sighting device for the weapon mounted on the lower gun carriage. In the disclosed embodiment, the means by which the gunner traverses the lower gun carriage is a traversing wheel on such carriage and the pivotal axis of the manual firing lever is coaxial of the traversing wheel and thus remains unchanged with respect to the lower gun carriage for every position of the gun barrel within the angular range through which it may be elevated.

14 Claims, 7 Drawing Figures

REPEATING FIRING SYSTEM FOR GUNS

BACKGROUND OF THE INVENTION

This invention relates to a repeating firing system for weapons with barrels capable of being elevated, the barrel with its elevating mechanism being mounted upon a horizontally traversable lower gun carriage which is capable of recoil movement upon the firing of the weapon. The firing operation is initiated by a firing device which is disposed on the barrel of the weapon, actuation of the firing device operating a mechanical or electrical ignition device for firing the weapon.

West German Auslegenschrift No. 1,149,276 discloses a cocking trigger provided on a gun and actuated by a triggering cable. Such device is mounted in a breach block unit and is equipped with a triggering lever which serves to rotate a triggering shaft, the triggering lever being deflectable by a triggering cable so as to rotate about an axis transverse to the axis of the bore of the weapon of the barrel.

The prior cocking trigger referred to above is particularly disadvantageous when it is mounted on a gun provided with a seat for a gunner, such seat following the traversing movement of the gun carriage. When the elevation of the gun barrel changes from its lower to its upper position, the position of the firing or triggering lever with respect to a sighting or similar device mounted upon the gun carriage is changed in such a manner that it is difficult to coordinate the operation of the triggering lever with the sighting end aiming of the weapon required of the gunner.

The triggering line or cable in the firing system according to the above-referred to Auslegeschrift No. 1,149,276 can be replaced by a transmission means such as a Bowden cable which can be operated from the gunner's seat. Such modified system, however, has the following drawbacks: The length of the Bowden cable has to be extremely variable because of variation in the angle of elevation of the gun barrel, which varies the distances to be bridged; this entails a considerable cost. The Bowden cable would have to be made sufficiently long so that its effective length could be varied in the required manner, as by means of deflections and reverses over the length of the cable. This, however, would only increase the force required to operate the triggering or firing lever, particularly at low temperatures, and also makes such Bowden cable more liable to failures and breakdowns. Maintenance of such system would thus be quite substantial.

SUMMARY OF THE INVENTION

The invention has among its objects the avoidance of the aforementioned drawbacks of the prior art and the provision of a repeating weapon firing system in which a repeating firing device is arranged in such a manner that the gunner, with every angular elevation of the gun barrel, can accurately coordinate the operation of firing the weapon with the operation of sighting and aiming it.

There is disclosed a repeating firing system in accordance with the invention for a weapon with a barrel mounted on a lower gun carriage which is capable of recoil and is horizontally traversed by the gunner, the barrel being capable of being elevated through a substantial angular range. The system includes a firing device capable of repeated operation which serves to actuate a striker pin device disposed on the barrel of the weapon and serving to initiate the firing of the weapon.

The firing system has a firing lever operable by the gunner from his weapon sighting and firing position, the firing lever serving to displace a release element, in opposition to the restoring force of a spring, from a position of rest to a firing position, from which, after the firing lever has been turned to effect the firing operation, it is returned by the restoring force of a spring to the position of rest in order to be ready to repeat the firing operation. The system includes means connecting the firing lever with a manual firing lever mounted on the lower gun carriage at the gunner's position in a fixed position relative to the directional and sighting device for the weapon mounted on the lower gun carriage. In the disclosed embodiment, the means by which the gunner traverses the lower gun carriage is a traversing wheel; the pivotal axis of the manual firing lever is coaxial of that of the traversing wheel and remains unchanged with respect to the lower gun carriage for every position of the gun barrel within the angular range through which it may be elevated.

In the embodiment disclosed herein the axis along which the firing pin is displaced is disposed in the same direction as the axis of the bore in the gun barrel and transverse to the axis of the striker pin of the repeating firing device of the invention. The repeating firing device and the striker pin device are separate from each other and disposed at a substantial distance from each other. When the barrel and lower gun carriage of the weapon are at rest, that is, after the gun carriage has returned to its initial position following a firing operation and its consequent recoil, a release device on the gun barrel is positioned coaxially of the firing pin of the firing device. The system includes means connecting the manual firing lever mounted on the lower gun carriage at the gunner's position in a fixed position relative to the lower gun carriage and the repeating firing device, the lever being capable of being turned about a fixed axis fixedly located with respect to a directional and sighting device on the lower gun carriage, the axis of rotation of the firing lever being coaxial with a traversing wheel for swinging the gun horizontally, such common axis remaining unchanged for every position of elevation of the gun barrel.

BRIEF DESCRIPTION OF THE DRAWINGS

The invention will be explained in detail below by reference to a preferred embodiment thereof illustrated in the accompanying drawings, in which.

GENERAL ORGANIZATION

Figure 1:
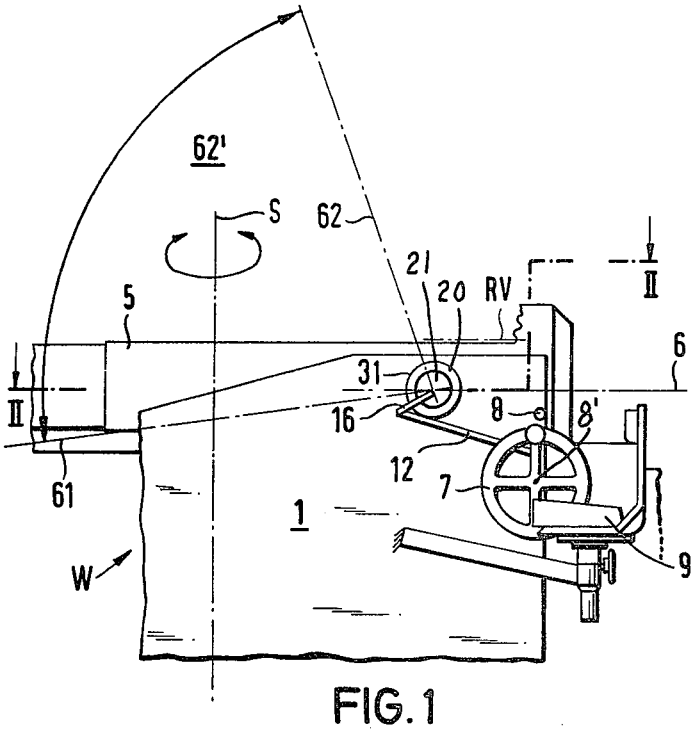
FIG. 1 is a simplified view in side elevation of a part of a gun equipped with a system of the invention, all components which would detract from the clarity of illustration being omitted.
Figure 2:
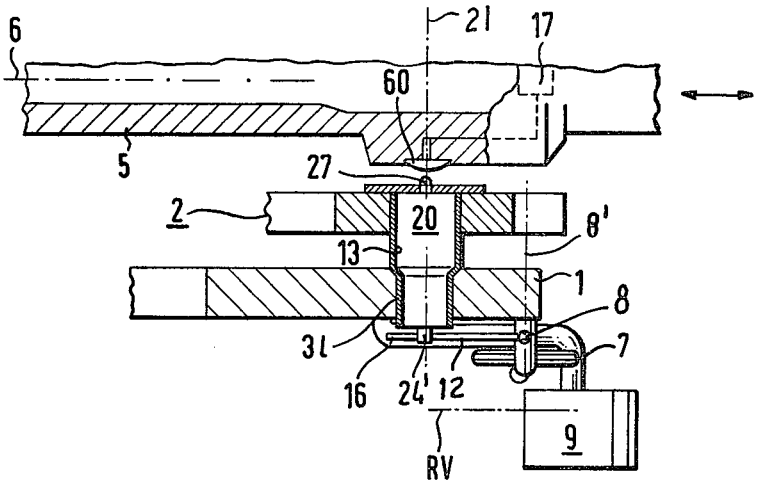
FIG. 2 is a fragmentary view in horizontal section through the apparatus of FIG. 1, the section being taken along the line II—II in FIG. 1.

Referring first to FIGS. 1-4, inclusive, of the drawings, a gun shown fragmentarily at W is provided with a lower gun carriage 1 which carries a gun barrel capable of recoil, the carriage 1 being capable of being swung horizontally, that is, traversed, with reference to the supporting structure (not shown) upon which the lower gun carriage is mounted. A traversing wheel 7 for thus traversing the lower gun carriage 1 is mounted upon such carriage within easy reach of a gunner seated upon a seat 9 which is affixed to and moves with the lower gun carriage. The traversing movement of the lower gun carriage 1 in a horizontal direction is indicated by the vertical axis S and the double-ended arcuate arrow S. The gun has a barrel 5 having an axis 6, the barrel being connected to the lower gun carriage 1 by aligned trunnions or stub shafts, of which one is shown at 31, having an axis 21 which is disposed at right angles to the axis 6 of the gun barrel. The barrel 5 of the gun is mounted upon an upper gun carriage 2, carriage 2 and thus the barrel 5 being mounted upon the lower gun carriage 1 by two aligned trunnions 31 only one of which is illustrated. At least one of the trunnions is hollow and contains a repeating firing device 20 in an enlarged portion 13 thereof. The mechanism by which the gunner raises the barrel 5 to a desired elevation is not here shown; the means for thus elevating the gun barrel is under the control of means supported on the lower gun carriage 1 within easy reach of the gunner seated upon seat 9. A sighting and aiming device RV, indicated schematically in FIGS. 1 and 2, has a part thereof mounted upon the gun barrel 5; the image transmitted by the device RV is forwarded to the gunner through an optical system such that the eye piece of the system RV always remains in the same position, convenient to the gunner, despite changes in the angle of elevation of the barrel 5 of the gun which, as shown in FIG. 1, may vary within the sector of 62' defined by a lower solid line 61 and an upper phantom line 62.

DETAILED DESCRIPTION

Figure 3:
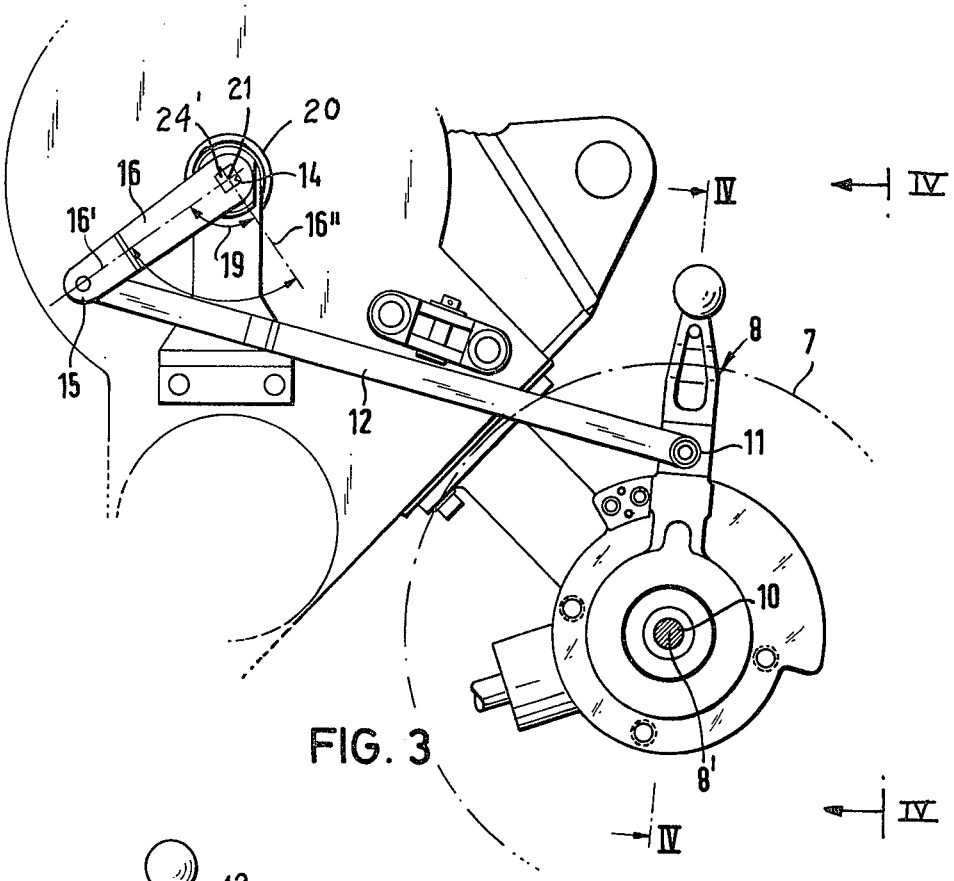
FIG. 3 is a fragmentary view on an enlarged scale of a portion of the apparatus shown in FIG. 1.
Figure 4:
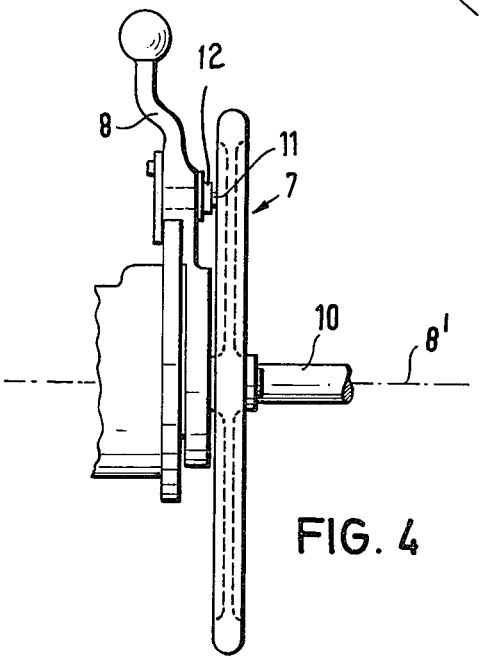
FIG. 4 is a fragmentary view in end elevation of the apparatus shown in FIG. 3, the view being taken from the position of line IV—IV in FIG. 3 looking in the direction of the arrows.

As most clearly shown in FIGS. 3 and 4, the wheel 7 for traversing the lower gun carriage 1 is mounted upon a horizontally disposed transverse wheel shaft 10 having a longitudinal axis 8', shaft 10 being journalled in a hub affixed to the lower gun carriage 1. A manual firing lever 8 is mounted upon such hub coaxial of shaft 10 and close to wheel 7, as shown in FIGS. 3 and 4.

The above-referred to repeating firing device 20 mounted within a trunnion 31, is operated by a firing lever 16 which is affixed to the axially outer end 24' of the firing shaft 24 of the device 20. The radially inner end of the lever 16 has a squared opening 14 therein fixedly receiving the squared outer end 24' of the firing shaft 24. As indicated in FIG. 3, lever 16 is capable of oscillation through the angle 19 defined between lines 16' and 16''. The manual firing lever 8 at the gunner's position is connected to the firing lever 16 of the repeating firing device 20 by an elongated link 12 one end of which is pivotally connected to the lever 8 by a pivotal connection 11 (FIGS. 3 and 4) and the other end of which is pivotally connected to the radially outer end of firing lever 16 by a pivotal connection 15 (FIG. 3).

It will be seen from the above that the common axis 21 of the repeating firing device 20, of the gun barrel 5, and of the firing shaft 24 is disposed parallel to and is spaced a fixed distance from the axis 8' of the traversing wheel shaft 10. Axes 8' and 21 are disposed transverse to the axis 6 of the gun barrel. It will thus be apparent that the elevations of the gun barrel 5 through any angle within the sector 62', with the lower gun carriage 1 in its at-rest position, as shown, the firing pin 27 of the firing device 20 is disposed in a predetermined fixed position longitudinally of the lower gun carriage 1. Mounted upon the barrel 5 upon the axis 21 is a release device 60 which is connected by means not shown, which may be either mechanical or electrical in nature, with the striker pin device 17 mounted upon the barrel 5. Thus the release device 50 is at all times, in the at-rest position of the lower gun carriage 1, disposed in alignment with the firing pin 27 of the firing device 20, so as to be ready for operation thereby.

By the expression "repeating firing device" what is meant is a device which remains in readiness for repeated operation. Thus, the firing device 20 may be repeatedly operated by the manual firing lever 8 after removal of a spent shell case from the breach of the barrel, and the reloading of the gun after the lower gun carriage 1 has assumed its at-rest position following its recoil.

Figure 5:
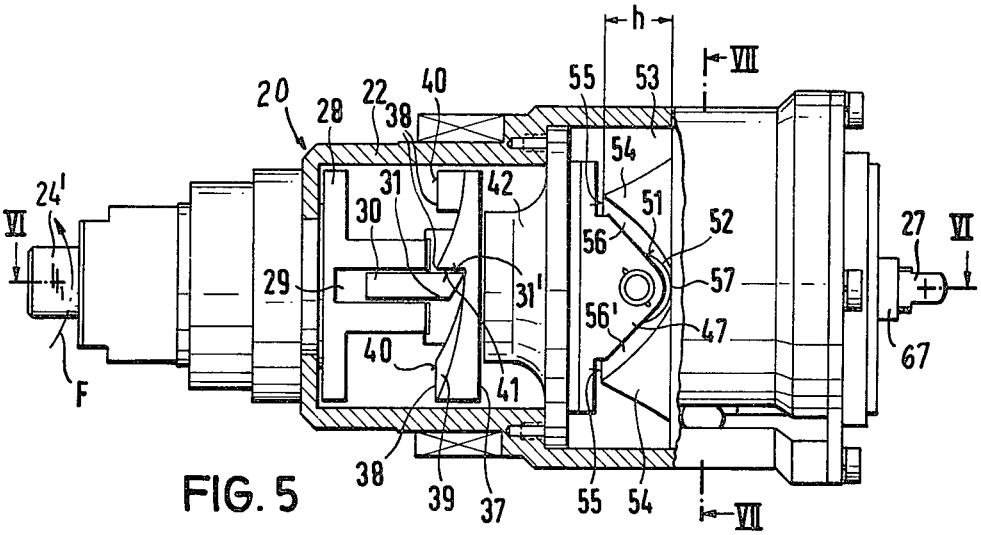
FIG. 5 is a view partially in plan and partially in longitudinal section of the repeating firing device of the invention.
Figure 6:
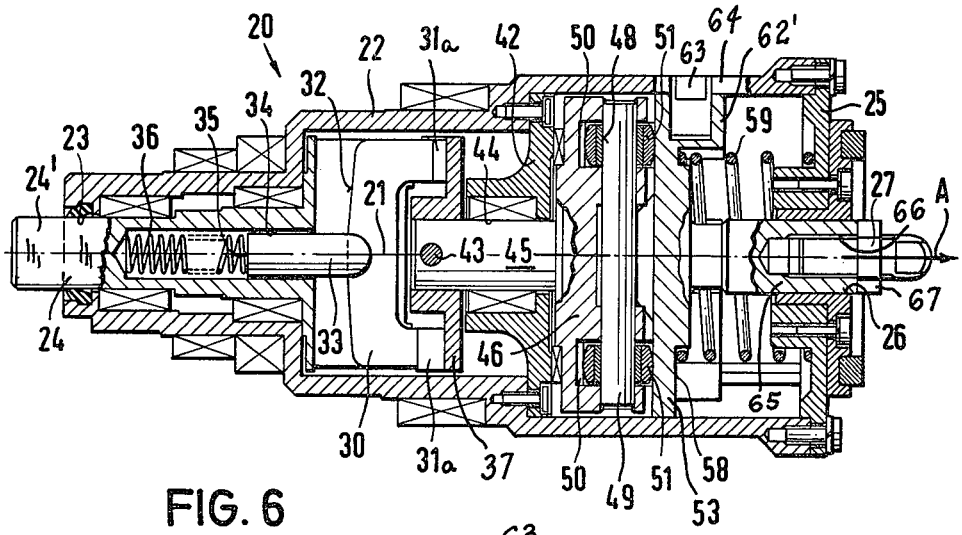
FIG. 6 is a view in longitudinal axial section through the repeating firing device, the section being taken in a plane at right angles to that of FIG. 5 and along the line VI—VI of FIG. 5.
Figure 7:
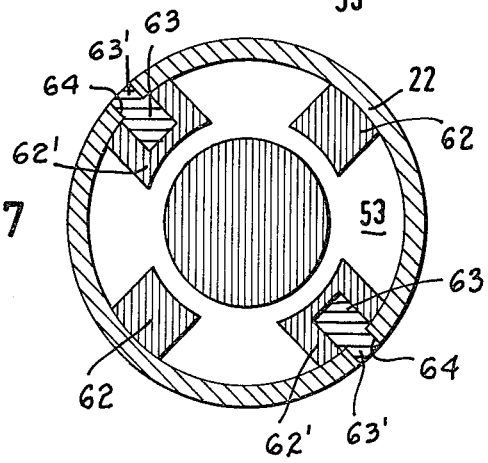
FIG. 7 is a view in transverse section through the repeating firing device, the section being taken along the line VII—VII in FIG. 5.

Turning now to FIGS. 5, 6 and 7, there is shown in detail the repeating firing device 20. Device 20 has a housing 22 in the form of a body of revolution having a longitudinal axis 21 (FIG. 6). The above-referred to firing shaft 24 of the device 20 is rotatably mounted within the left-hand end (FIG. 6) of the housing 22 by bearings shown schematically. A rubber or rubber-like annular sealing member 23 is mounted in an annular groove in the left-hand end of the housing 22 to seal the interior of the housing from the atmosphere. The right-hand end of the housing 22 is provided with a cover 25 which is bolted to the housing, as shown. The above-mentioned firing pin 27 extends through a central opening in the cover 25, there being an annular resilient sealing means 26 interposed between the central opening in the cover 25 and the firing pin 27.

The axially inner end of the firing shaft 24 has fixedly secured thereto a rotatable supporting body 28 in the form of a transverse flange having two symmetrically disposed longitudinally extending and laterally spaced parallel members extending axially thereof to present a parallel sided slot 29 therebetween. A C-shaped plate member 30 is disposed for axial reciprocation within the slot 29, member 30 being held coaxial of the axis 21 by a guide pin 33 connected to the rear end thereof and mounted for reciprocation in an axially extending bore 34 in the inner end of the firing shaft 24. As shown, the forward end of the guide pin 33 is secured to the rear end 32 of the C-shaped member 30. Pin 33 and the C-shaped member 30 secured thereto are constantly urged to the right (FIGS. 5 and 6) by a coil compression spring 36 in bore 34 interposed between the blind end of the bore and the axially outer end of the pin 33. It will be seen from the above that the member 30 rotates with the supporting body 28 about the axis 21 of the repeating firing device 20.

A transverse plate 42 fixedly secured to the housing 22 intermediate the length thereof, as shown, has an axially outwardly or rearwardly extending hub which is coaxial of the axis 21 of the device 20. A ratchet body 37 is affixed by a transverse pin 43 to a shaft 45 which is rotatably supported by a bearing sleeve 44 mounted in the hub on the plate 42. The ratchet body 37 on the side thereof facing the C-shaped member 30 is provided with four teeth 38 which are spaced 90° apart about the axis 21. The free ends of the C-shaped member 30 are formed as teeth 31*a* sloping in the same direction, each tooth 31 having a flank 31' disposed parallel to the axis 21 of device 20. The teeth 38 on ratchet body 37 have axially extending flanks which engage the flanks 31' of teeth 31*a* when the parts are positioned as shown in FIG. 5. The left-hand end surface 40 of the ratchet body 37 between the high points of the teeth 38 thereon is smoothly curved to the root of the next neighboring tooth, as shown at 39.

Integrally connected to the right-hand end of the shaft 45 is a transversely extending member 46 which is provided with two symmetrically located axially forwardly extending projections or ears 47 disposed diametrically opposite each other with respect to the axis 21. The two projections 47 have aligned transversely extending bores therein disposed along a diameter of the housing 22, bores 48 serving to support the opposite ends of a transversely disposed shaft 49. Each projection 47 is provided intermediate the length of its bore 48 with a recess 50 which accommodates a respective roller 51 mounted on the shaft 49, the periphery 52 of each of rollers 51 extending axially forwardly beyond the forward ends of the projections 47. As shown in FIGS. 5 and 6, the axis of shaft 49 is disposed in the same diametral axial plane as the flanks 41 of the teeth 38 in one set of such teeth on the ratchet body 37.

Disposed within the housing 22 adjacent the forward or right-hand end thereof is a transversely extending plate or deflecting member 53 which is axially reciprocable with respect to the housing. The left-hand surface of member 53 is provided with four control projections 54 spaced 90° apart about the axis 21. Each control projection 54 has a ridge 55 facing rearwardly (to the left) of the housing. The ridges 55, pairs of opposite ones of which face each other, are interconnected by a curved roller track 56 which is subdivided by the ridges 55 into four geometrically equal sections each of which is provided with a depression 57. Pairs of the depressions 57 are disposed diametrically opposite one another, successive depressions being spaced 90° apart and midway between successive ridges 55. The ridges 55 are all located in one transverse plane, and the depressions 57 are all located in a second transverse plane which is axially spaced from the first transverse plane by the distance h.

Integrally connected to the deflecting member or plate 53 and projecting axially forwardly therefrom is a hollow central shaft 65 having a central threaded bore 66 therein. The axially inner end of the firing pin 27 is threadedly received within bore 66, and is held in axially adjusted position by a lock nut 67. The member 53 and the shaft 65 attached thereto are constantly urged toward the left by a coil compression spring 59 which is disposed between a spring seat on the axially inner surface of cover 25 and a spring seat on the axially forward surface of member 53. The latter spring seat is formed by a plurality of radially inwardly projecting equally angularly spaced enlargements on the member 53, two of such enlargements designated 62 being solid and aligned diametrically opposite each other, the remaining two of such enlargements, designated 62', each having a recess therein receiving a key member 63 having a radially outer end portion 63' extending into a longitudinally extending slot 64 in the wall of the housing 22 in order to retain the member 53 and the firing pin 27 from rotation relative to the housing 22.

The above-described apparatus of the invention functions as follows: Let us assume that the gunner, constantly observing the sighting and aiming device RV, has rotated the traversing wheel 7 in order to move the gun W into the firing position. In order to fire the gun, the gunner pulls the manual firing lever 8 in a clockwise direction (FIG. 1) about the axis 8'. Because of the advantageous spatial interrelationship between the manual firing lever 8 on the one hand and the gunner's seat 9 and the traversing wheel 7 on the other, the gunner need not alter his bodily position, in addition to which he can continue his concentrated attention to the aiming and sighting device RV. When the manual firing lever 8 is pivoted, the firing lever 16 is moved out of its initial position, indicated by the dot-dash line 16' in FIG. 3, in a counterclockwise direction about the axis 21, passing through the angular sector 19 and reaching the final position indicated by the dot-dash line 16''. The sector 19 has a central angle of at least 90°. As a result of the driving connection between the firing lever 16 and the end 24' of the firing shaft 24, the firing shaft 24 is rotated in the direction indicated by the arrow F (FIG. 5). During such rotation of the shaft 24, the flanks 31' of the teeth 31 on the member 30 engage the teeth surfaces 41 on the ratchet body 37, thereby causing the body 37 to turn with the member 30. The rollers 51 on the body 37 move out of the position thereof shown in FIG. 5 wherein they lie in respective depressions in the deflecting body 53, to that section of the roller track 56 thereon which is nearest to the set position in the direction of rotation, the deflecting body 53 being thereby moved axially in opposition to the force of the spring 59, thereby displacing the firing pin 27 to the right, that is, in the direction indicated by the arrow A. When the rollers 51 have reached the nearest ridges 55, the deflecting body 53 and the firing pin 27 attached thereto will have moved axially a distance h in an operative stroke. Stroke h is of such length that the firing pin 27 in its forward terminal position engages the release device 60 of the striker pin device 17, so that the device 17 is actuated.

The above-described process sets up the firing operation, in the course of which the barrel 5 and upper carriage 2 recoil, that is, moved toward the right by reason of the effect of the recoil energy, and the release device 60 moves to the right (FIG. 2) out of the location of the pivotal axis 21 of the barrel 5 in its at-rest position. The angle 19 through which the firing lever 16 rotates amounts to at least 90°, so that the rollers 51 run over the respective ridges 55 on the member 53. This has the advantage of insuring that the deflecting body 53, and with it the firing pin 27, return to their initial positions shown in FIG. 5, opposite the direction indicated by the arrow A, as a result of the force of the restoring spring 59. The release device 60 and the firing pin 27 thus again are in alignment, and the gun is ready to be fired again when a new shell has been put into place. Such repeating process advantageously takes place not only rapidly but also independently of the particular position occupied by the firing lever 16 within the angle of deflection thereof indicated at 19. This ensures that the repeating firing device 20 will not be damaged when the barrel 5 moves forwardly and backwardly in a direction transverse to the axis of the trunnions 31. This factor is very important particularly since the gunner, for various reasons, may be prevented, in certain combat situations, from returning the manual firing lever 8 to its initial position. When the manual firing lever 8 is subsequently moved back in a counterclockwise direction, the driving member 30, owing to its displaceability in the direction of the axis 21, may avoid ascending a ramp or run-up surface 29 until a tooth edge 40 has been passed, and rapidly returns after overcoming the tooth edge 40, to the initial position shown in FIG. 5 under the force of the restoring spring 36. In this process the position of the firing pin 27 is advantageously left unaffected.

The repeating firing device 20 is advantageously constructed as a self-contained installation assembly. It is thus removable and replaceable and easily maintained; these factors render the gun more readily available for use. The firing pin 27 is advantageously variable in length, as described above. Any dimensional deviations can thus be overcome, so that the repeating firing system according to the invention can be adapted, as an interchange assembly, to any conditions which may arise. The resulting advantages, from a logistics viewpoint, are so obvious as to require no further elaboration.

Although the invention is illustrated and described with reference to a single preferred embodiment thereof, it is to be expressly understood that it is in no way limited to the disclosure of such a preferred embodiment, but is capable of numerous modifications within the scope of the appended claims.

I claim:

1. In a weapon having a barrel capable of being elevated, the weapon having a traversible lower gun carriage, a striker pin device on the barrel for initiating the firing of the weapon, a release device on the barrel for actuating the striker pin device, a repeating firing device for actuating the release device, the repeating firing device having a reciprocable firing pin which is advanced by an oscillatable firing lever against the opposition of a spring to actuate the release device from a position of rest to a firing position from which the firing lever has been turned to effect the firing operation it is returned by the restoring force of the spring to its position of rest, a directional and sighting device for the weapon readily accessible to a gunner occupying the gunner's position from which he fires the weapon, and a rotatable wheel at the gunner's position to traverse the lower gun carriage, the improvement wherein the axis along which the firing pin reciprocates is disposed transverse to the axis of the bore of the barrel and the axis of reciprocation of the striker pin, the repeating firing device and the striker pin device are separate and spaced from each other, when the barrel is in its rest position the release device is disposed in alignment with the firing pin of the repeating firing device, the firing lever is operatively connected to a manually operated oscillatable firing lever which is spaced therefrom and which is located adjacent the gunner's position, the repeating firing device being so located relative to the directional and sighting device, the lower gun carriage, and the axis of rotation of the lower gun carriage traversing wheel that the axis of oscillation of the manually firing lever remains unchanged for every position of elevation of the gun barrel, the axis of rotation of the traversing wheel and the axis of oscillation of the manually operated firing lever coinciding, the traversing wheel and manually operated firing lever being located in the immediate vicinity of each other, the repeating firing device comprising a housing, a firing shaft rotatably mounted within the housing for oscillation by the firing lever, the firing shaft being mounted coaxially of the trunnion axis, a face cam mounted for rotation by and coaxial of the firing shaft, a cam follower reciprocable with respect to the housing cooperating with the cam, the firing pin being mounted upon the cam follower coaxial of the firing shaft.

2. A weapon in accordance with claim 1, wherein the face cam is rotatably mounted in the housing and is connected with the firing shaft through indexing means which drives the cam in only one direction of rotation.

3. A weapon in accordance with claim 1, wherein the face cam and the cam follower are provided on respectively facing surfaces with at least one roller and with a roller track, respectively.

4. A weapon in accordance with claim 3, wherein the roller track forms a circular ring in a plane projection transverse to the axis of the firing shaft and follows a closed control curve, the roller track having at least three control projections and depressions, the projections being equidistant from each other and coaxial of and surrounding the firing shaft.

5. A weapon in accordance with claim 4, wherein each of the control projections is provided with a ridge, and the depressions are disposed equally angularly around the firing shaft.

6. A weapon in accordance with claim 5, wherein the ridges are disposed in a first transverse plane and the depressions are each situated in a second transverse plane spaced axially from the first transverse plane.

7. A weapon in accordance with claim 6, wherein the cam follower is arranged so that it can be reciprocated axially of the housing through a predetermined distance and comprising a restoring spring which opposes the axial advance of the cam follower.

8. A weapon in accordance with claim 7, wherein the indexing means is a ratchet device.

9. A weapon in accordance with claim 8, wherein the ratchet device has a ratchet body with teeth thereon having flanks parallel to the axis of the firing shaft, such teeth being disposed equally angularly about the axis of the firing shaft, the number of teeth on the ratchet body being equal to the number of ridges on the one hand and depressions on the other hand of the cam follower.

10. A weapon in accordance with claim 9, wherein the ratchet device includes a driven means connected with the firing shaft, such driven means including a member bearing ratchet teeth which is displaceable axially of the firing shaft and cooperates with a confronting, second tooth member which is driven thereby.

11. A weapon in accordance with claim 10, wherein the angle through which the firing lever is oscillatable is at least equal to the angle between the bearing flanks of successive teeth on the second toothed member of the ratchet device, and corresponds at least to the angle between successive ridges on the one hand and successive depressions on the other hand of the cam and the cam follower, respectively.

12. A weapon in accordance with claim 7, wherein the repeating firing device is constructed as an installation unit which may be readily installed as a replacement assembly.

13. A weapon in accordance with claim 11, wherein the repeating firing device is constructed as an installation unit which may be readily installed as a replacement assembly.

14. A weapon in accordance with claim 12, wherein the firing pin is adjustable in its effective axial length, and comprising means for locking the firing pin in its adjusted length position.

* * * * *